United States Patent [19]

Klinger et al.

[11] 4,443,364

[45] Apr. 17, 1984

[54] DETERGENT COMPOSITION CONTAINING AN ANTIFOAMING AGENT FOR CLEANING HARD SURFACES AND METHOD OF USING THE SAME

[75] Inventors: Wolfgang Klinger, Altötting; Eckhard Milewski, Kriftel, both of Fed. Rep. of Germany

[73] Assignee: Hoechst Aktiengesellschaft, Fed. Rep. of Germany

[21] Appl. No.: 330,768

[22] Filed: Dec. 14, 1981

[30] Foreign Application Priority Data

Dec. 23, 1980 [DE] Fed. Rep. of Germany ..... 3048641

[51] Int. Cl.[3] ..... C11D 1/38

[52] U.S. Cl. ..... 252/547; 252/122; 252/156; 252/528; 252/106; 252/DIG. 10; 134/42

[58] Field of Search ..... 252/547, 174.21, DIG.14, 252/89.1, 106, 156, 158, DIG.10, 528, 122

[56] References Cited

U.S. PATENT DOCUMENTS 4,174,304 11/1979 Flanagan ..... 252/524
4,284,532 8/1981 Leikhim et al. ..... 252/528

FOREIGN PATENT DOCUMENTS 154418 4/1948 Australia .
2523588 5/1975 Fed. Rep. of Germany .
873214 7/1961 United Kingdom .
994607 6/1965 United Kingdom .
2004534 4/1979 United Kingdom .

*Primary Examiner*—John E. Kittle
*Assistant Examiner*—José G. Dees
*Attorney, Agent, or Firm*—Connolly and Hutz

[57] ABSTRACT

A detergent composition which is particularly suitable for the mechanical cleaning of hard surfaces, in particular glass, porcelain and the like, in a cleaning liquor within the alkaline range, is described. This detergent composition comprises (A) a nonionic surfactant selected from the group comprising polyalkylene glycol monoalkyl ethers containing ethylene oxide and propylene oxide units, polyglycol ether formals containing ethylene oxide units and, if appropriate, propylene oxide units, or polyalkylene glycol dialkyl ethers containing ethylene oxide units and, if appropriate, propylene oxide units, (B) a selected quaternary ammonium compound as a cationic surfactant, and (C) a fluorinated alcohol as an antifoaming agent.

These compositions are particularly suitable for industrial crockery-cleaning and bottle-cleaning plants which are operated with considerable mechanical agitation of the liquor within a highly alkaline pH range.

10 Claims, No Drawings

DETERGENT COMPOSITION CONTAINING AN ANTIFOAMING AGENT FOR CLEANING HARD SURFACES AND METHOD OF USING THE SAME

The invention relates to a detergent-composition, containing an antifoaming agent, for the mechanized cleaning of hard surfaces, in particular bottles and crockery, in a cleaning liquor which is within the alkaline to highly alkaline range.

Nowadays, mechanical cleaning processes are extensively used for cleaning bottles and other objects having hard surfaces, such as crockery made of porcelain, ceramics, glass or plastics, and also other glass or metal objects. Whereas in the case of domestic dishwashing machines, only a relatively gentle agitation of the liquor is necessary, corresponding to the low throughput of material to be cleaned, commercial and, in particular, industrial cleaning plants operate at a high throughput rate, with very considerable agitation of the liquor and intensity of spraying. Owing to the higher loading of soil, this sets stringent requirements for the quality of the surfactant-containing cleansing agent employed, in respect of its cleansing power, soil uptake capacity and wetting power. In order to ensure the necessary rapid removal and emulsification of the adhering impurities, it is customary to carry out the process in highly alkaline liquors in commercial cleaning plants of this type and, in particular, in industrial cleaning plants. Owing to the considerable mechanical agitation of the liquor, the system must also have as low a foam content as possible, or be free from foam, since excessive foam formation can lead to interruptions in the performance of the plant, for example if the soil accumulating in the layer of foam cannot be discharged to an adequate extent. Additional tendencies to the formation of foam are caused by the impurities brought into the liquor by the material to be cleaned, particularly by protein-containing residues on the material to be cleaned. In the case of bottle cleaning, this also applies particularly to the labels which have to be removed and which are introduced into the cleaning liquor by the residues of glue and of printing inks, including the surfactant auxiliaries contained in the latter.

It is known to employ nonionic surfactants having low-foaming characteristics as cleaning agents for hard surfaces in alkaline baths. These are, in particular, addition reaction products of ethylene oxide and/or propylene oxide with amines, fatty alcohols or alkylphenols having a fairly long chain or polyglycol ether formals or acetals, or block copolymers of ethylene oxide and propylene oxide. Surfactant systems of this type can be formulated, in particular by suitably varying the proportions of ethylene oxide and propylene oxide, to have as low a tendency to foaming as possible and an increased cleaning action, an excess of propylene oxide favoring the first property, while an excess of ethylene oxide favors the latter property. However, such a formulation of these properties always represents a compromise, and it would be desirable to obtain more of the first property without having to dispense with a fraction of the second property. Although, in the case of mechanized cleaning processes for bottles, crockery and the like in the industrial sector, which are carried out with considerable mechanical agitation, the low foam content of the surfactant systems mentioned is very desirable, the removal of soil in the short time of throughput available for the material to be cleaned, and also the soil uptake capacity, are frequently not adequate and are in need of improvement.

Attempts have already been made to compensate for this disadvantage by means of specific mixtures belonging to the said categories of nonionic surfactants, as described in German Auslegeschrift No. 2,723,139. Although such mixtures have an advantageously low tendency to foaming at the higher operating temperature of the plant, they have too high a tendency to foaming at lower temperatures, which is disadvantageous when charging and heating up the plant. Recourse to anionic surfactants, which would increase the cleaning and wetting power, is hardly possible, since this will increase the tendency to foaming too greatly. Attempts have also already been made, for disinfecting purposes, to include, in the bottle cleaning agent, cationic surfactants having long alkyl chains. This is described in German Offenlegungsschrift No. 2,449,354, in which the cationic surfactants employed are quaternary ammonium salts containing one or two long-chain alkyl radicals or alkylaryl radicals in the molecule, as well as short-chain radicals. Since this type of cationic surfactants has a tendency to relatively severe formation of foam, it is also necessary to add an antifoaming agent, orthophosphoric acid monoalkyl esters being envisaged for this purpose in this text. In some cases, nonionic surfactants can also be present in the mixture. However, formulations of this type, which include cationic quaternary ammonium compounds containing at least one long alkyl chain, have the decisive disadvantage that the said compounds are absorbed substantively onto the material to be cleaned. This prevents the liquid from flowing off smoothly; drops are formed and these then leave behind troublesome edges as the material dries. This effect, which is very desirable when the products are used as a fabric after-treatment agent for textiles, makes the use of the said quaternary ammonium compounds in crockery and bottle cleaning agents for alkaline liquors very problematical. Also, if the said quaternary ammonium compounds are employed as a mixture with nonionic surfactants, as is similarly described in German Offenlegungsschrift No. 2,449,354 and also in German Offenlegungsschrift No. 2,523,588, no appreciable increase in the soil uptake capacity of the nonionic component is achieved.

There was, therefore, the object of improving the soil uptake capacity of such mixtures without having to accept the disadvantage of substantivity, in which connection a minimum tendency to foam formation should be achieved even with extremely great agitation of the liquor and/or extremely foam-promoting soil.

This is achieved, in accordance with the invention, by means of a detergent composition which comprises (A) 20 to 95% by weight, of the total weight of the mixture A+B, of a nonionic surfactant of the formula

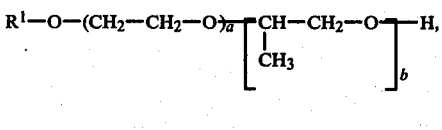

$$R^1-O-(CH_2-CH_2-O)_a-\left[CH(CH_3)-CH_2-O\right]_b-H, \quad (A^1)$$

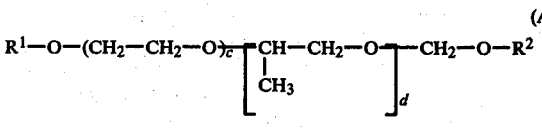

$$R^1-O-(CH_2-CH_2-O)_c-\left[CH(CH_3)-CH_2-O\right]_d-CH_2-O-R^2 \quad (A^2)$$

or

-continued $$R^1-O-(CH_2-CH_2-O)_c-\left[CH(CH_3)-CH_2-O\right]_d-R^3 \quad (A^3)$$

or a mixture of the formulae ($A^1$), ($A^2$) and/or ($A^3$), in which $R^1$ is an alkyl radical having 6 to 22 C atoms, $R^2$ is an alkyl radical having 1 to 6 C atoms, $R^3$ is an alkyl radical having 1 to 4 C atoms, a is a statistical average value within the range from 2 to 10, b is a statistical average value within the range from 1 to 8, c is a statistical average value within the range from 5 to 20 and d is a statistical average value within the range from 0 to 3, and (B) 5 to 80% by weight, of the total weight of the mixture A+B, of a cationic surfactant of the formula

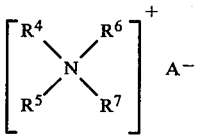

in which $R^4$ and $R^5$ are identical or different alkyl radicals having 1 to 12 C atoms, $R^6$ is an alkyl radical having 1 to 8 C atoms and $R^7$ is an alkyl radical having 1 to 4 C atoms or a benzyl radical, and A denotes an anion, and, additionally, (C) 0.001 to 20% by weight, relative to the total weight A+B=100, of a fluorinated alcohol of the formula

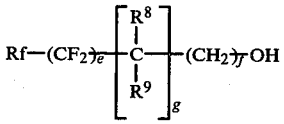

in which Rf is a perfluoromethyl or perfluoroisopropyl radical, $R^8$ is an alkyl radical having 1 to 3 C atoms, $R^9$ is hydrogen or an alkyl radical having 1 to 3 C atoms, e denotes an integer from 5 to 15, f denotes an integer from 0 to 4 and g assumes the value 0 in the case of f=1 to 4, and assumes the value 1 in the case of f=0.

The effectiveness of these agents for the mechanical cleaning of crockery, bottles and other glass objects, or metals, in alkaline cleaning liquors, in particular also in the highly alkaline cleaning liquors used in the industrial sector, is based on the surprising finding that the inclusion, as the cationic component, of quaternary ammonium compounds containing exclusively short to average chains in the molecule, makes it possible to improve considerably the soil uptake capacity of such mixtures, these cationic surfactants, within the alkaline range, not being absorbed substantively, for practical purposes, onto the material to be cleaned, and that, moreover, because of the fluorinated alcohols which have been added as antifoaming agents, such agents have, at the same time, an extremely low tendency to foaming both at low temperatures and at elevated temperatures and not only when the liquor is subjected to extremely high mechanical stresses, but also in the presence of soil which greatly promotes foaming.

The nonionic surfactants (A) employed as a constituent are known. These are:

($A^1$) addition reaction products of alcohols having 6 to 22 carbon atoms with ethylene oxide and propylene oxide, these ethylene oxide and propylene oxide units being present in the form of blocks and at least part, preferably all, of the propylene oxide being added by condensation after the addition reaction of the ethylene oxide. Condensation products of this type are known, for example from German Auslegeschrift No. 1,135,122, in particular from their use in washing agents for textiles. They correspond to the general formula $$R^1-O-(CH_2-CH_2-O)_a-\left[CH(CH_3)-CH_2-O\right]_b-H;$$

in which $R^1$ denotes an alkyl radical having 6 to 22 C atoms, preferably 7 to 18 C atoms, a denotes a statistical average value within the range from 2 to 10, preferably 3 to 8, and b denotes a statistical average value within the range from 1 to 8, preferably 3 to 5. Such an average value can be a whole or fractional number. The ratio of ethylene oxide to propylene oxide units should preferably be within the range from 0.8 to 2.

They are also:

($A^2$) polyglycol ether formals of the general formula $$R^1-O-(CH_2-CH_2-O)_c-\left[CH(CH_3)-CH_2-O\right]_d-CH_2-O-R^2;$$

these formals contain ethylene oxide units and, if appropriate, propylene oxide units, it being possible, in the event that both are present, for these units to be distributed statistically or to be incorporated as blocks. Such polyglycol ether formals can be prepared, for example, from the corresponding polyglycol ethers and formaldehyde, as described in German Offenlegungsschrift No. 2,523,588. In the said formulae, $R^1$ denotes an alkyl radical having 6 to 22 C atoms, preferably 8 to 18 C atoms, $R^2$ denotes an alkyl radical having 1 to 6 C atoms, preferably the n-butyl radical, c denotes a statistical average value within the range from 5 to 20, preferably 6 to 14, and d denotes a statistical average value within the range from 0 to 3, preferably 0.

Finally, the nonionic component ($A^3$) can also be a polyalkylene glycol dialkyl ether of the formula $$R^1-O-(CH_2-CH_2-O)_c-\left[CH(CH_3)-CH_2-O\right]_d-R^3$$

which contains ethylene oxide units and, if appropriate, propylene oxide units, which can be arranged in a statistical distribution or in blocks. In this formula, $R^1$ denotes an alkyl radical having 6 to 22 C atoms, preferably 8 to 18 C atoms, $R^3$ denotes an alkyl radical having 1 to 4 C atoms, preferably the tert.-butyl radical, c denotes a statistical average value within the range from 5 to 20, preferably 6 to 14, and d denotes a statistical average value within the range from 0 to 3, preferably 0.

The abovementioned nonionic surfactants can also be present in the form of mixtures of products within the groups ($A^1$), ($A^2$) or ($A^3$) or else mixtures between the groups ($A^1$), ($A^2$) and/or ($A^3$). The nonionic surfactants preferably belong to group ($A^1$).

As the cationic component, the detergent composition contains a quaternary ammonium compound B of the formula

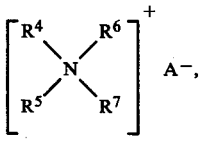

in which $R^4$ and $R^5$ are identical or different and denote an alkyl radical having 1 to 0.12 C atoms, preferably 4 to 8 C atoms and, in particular, 4 to 6 C atoms, $R^6$ denotes an alkyl radical having 1 to 8 C atoms, preferably 1 to 6 C atoms, and $R^7$ denotes an alkyl radical having 1 to 4 C atoms, or a benzyl radical. A is an anion, preferably a chloride or bromide anion, or an anion of the formula $CH_3OSO_3^-$.

The fluorinated alcohols of the formula

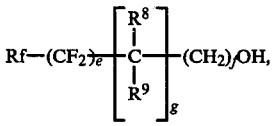

in which Rf is a $CF_3$ or $(CF_3)_2$—CF radical, $R^8$ is a lower alkyl radical, $R^9$ is hydrogen or a lower alkyl radical (a lower alkyl radical being understood here as meaning a radical having 1 to 3 C atoms, preferably a methyl or ethyl radical), e is an integer from 5 to 15, f is an integer from 0 to 4 and g assumes the value 0 in the event that f=1 to 4 and assumes the value 1 in the event that f=0, which are employed as antifoaming agents in the detergent composition according to the invention, are substances which are known per se. They can be prepared as described, for example, in U.S. Pat. No. 3,171,861, in German Patent Specification No. 2,028,459, in German Patent Specification No. 1,214,660, in French Patent Specification No. 1,438,617, in European Laid-Open Specification No. 8,096 and in J. Chem. Soc. 1953, pages 1748 et seq. and in J. Am. Chem. Soc. 79 (1957), pages 335 et seq. Amongst the fluorinated alcohols which are employed in the detergent composition according to the invention, preferential mention should be made of those in which, in the abovementioned formula, Rf is $CF_3$, e is 5 to 13 and g is 0, f assuming values of 1 to 4, in particular a value of 2. Fluorinated alcohols which are preferred by reason of their preparation are, in particular, those in which Rf is $CF_3$ and e assumes odd values, that is to say 5, 7, 9, 11 and 13.

The proportion of components of the detergent compositions is of considerable importance for their advantageous properties. In order to achieve the required optimum combination of soil uptake capacity, minimum tendency to foaming and nonsubstantivity, the ratio of the components A:B in the mixture A+B should be within the range from 20:80 to 95:5% by weight, preferably from 30:70 to 70:30% by weight. In addition, the fluorinated alcohol (C) is present in the mixture according to the invention as an antifoaming agent in a quantity of 0.001 to 20% by weight, preferably 0.1 to 15% by weight, relative to the total weight of the components A+B=100. Fluorinated alcohols of this type constitute wax like substances which are solid at room temperature. They can be added without a diluent to the mixture of the components A+B or to the individual components thereof, appropriately while warming gently and stirring. However, it is advantageous to introduce these fluorinated alcohols as a mixture with a solubilizer in which they have been dissolved beforehand. This applies above all if very small quantities of the fluorinated alcohol are to be used. A suitable solubilizer must be capable of forming a completely or at least substantially homogeneous mixture with the detergent composition A+B or the individual components thereof. The fluorinated alcohol (C) should also be substantially or completely soluble in this solubilizer. An effective quantity of such a solubilizer is preferably 1 to 1,000 parts by weight per part by weight of the fluorinated alcohol; this effective quantity should, however, not exceed 20% by weight of the total weight of the components A+B.

Examples of such solubilizers are aliphatic ketones, such as dimethyl and diethyl ketone, carboxylic acid esters of aliphatic alcohols and diols, such as ethyl acetate, isobutyl acetate, ethylene glycol acetate or 2-ethylhexyl 2-ethylhexanoate, acid amides of carboxylic acids having fairly long chains, such as, for example, N-(2-ethylhexyl)-isononanoamide, polypropylene glycols having molecular weights >600 and mixed polyglycols formed from ethylene oxide units and propylene oxide units, ethylene glycol monoethers and propylene glycol monoethers and the corresponding polyglycol ethers, such as methyl, ethyl and butyl monoethers of diethylene glycol, triethylene glycol and tetraethylene glycol. Alkanols having 1 to 9 C atoms in a straight or branched chain should be mentioned preferentially. Provided they are miscible with one another, mixtures of such solubilizers are also suitable.

The detergent compositions according to the invention can be employed in an undiluted, liquid form as a mixture of the components A+B+C, if appropriate including the solubilizer. They can, however, for example for the sake of better meterability, also be used in the form of aqueous concentrates, if appropriate also with the addition of an organic solvent which is not a solubilizer in the sense mentioned above. Equally, it is also possible first to add the components A and B, individually or together, to the aqueous cleaning liquor and to meter in the fluorinated alcohol C subsequently, in which case a solubilizer must be present. However, it is also possible to introduce the component C premixed with one of the two components A or B, the other component being metered in subsequently in each case.

The concentration for use is appropriately 0.05 to 10 g of the detergent composition A+B (not including C) per liter of cleaning liquor, preferably 0.1 to 2 g per liter. Such concentrations for use are not critical data, since the quantity depends to a certain extent on the nature of the surface to be cleaned and on the nature and extent of the impurities.

Further additives and auxiliaries can be mixed into the detergent compositions according to the invention, if appropriate when commercial formulations are prepared. These are, for example, dyestuffs, perfumes, corrosion inhibitors and disinfectants. Particular mention should also be made here of the known builders, which are in some cases complex-forming agents at the same time. Suitable examples of these are the condensed phosphates, such as tripolyphosphate and, in particular, pentasodium triphosphate. These are also complex-forming aminopolycarboxylic acids and salts thereof, such as, above all, alkali metal salts of nitrilotriacetic acid and of ethylenediaminetetraacetic acid, and also complex-forming hydroxycarboxylic acids and polymeric carboxylic acids, such as citric acid, tartaric acid and the like. A further class of complex-forming builders is constituted by salts of polyphosphonic acids, such as, for example, the alkali metal salts of aminophosphonic acid. Finally, it is also possible to add builders such as silicates, for example sodium metasilicate, carbonates, bicarbonates, borates and citrates. The compositions according to the invention can, if appropriate, be converted into the form of powder with the aid of such additives and can also be used in this form.

The detergent compositions according to the invention are suitable for the mechanical cleaning of hard surfaces in alkaline liquors. This applies to cleaning in domestic dishwashing machines and so-called commercial cleaning plants. However, the compositions are particularly suitable for industrial cleaning plants for hard surfaces, for example plants for washing crockery and bottles, which operate continuously with considerable mechanical agitation of the liquor and in highly alkaline liquors at pH values of $\geqq 10$, preferably $\geqq 12$.

The necessary alkaline additives, for the highly alkaline pH range of the liquor, preferably sodium hydroxide or potassium hydroxide, can be dissolved in the aqueous cleaning liquor before introducing the detergent compositions according to the invention. However, they can also be added direct to the composition and can be metered in together with the latter. The alkaline agent is appropriately added in the form of powder, flakes or pellets.

As well as the high stability to alkalis which is required for this purpose, the compositions according to the invention have an extremely low tendency to foam formation, which is indispensable for industrial cleaning plants. In this connection it is a factor of considerable importance that the fluorinated alcohol C employed as the anti-foaming agent should also be absolutely stable in the highly alkaline range. Its addition ensures that virtually no foam formation takes place even with extremely great mechanical agitation of the liquor, such as takes place, for example, in the bottle cleaning plants of breweries. The tendency to foam formation is also reduced to a minimum in the case of soil which has a strong to extremely strong foam-promoting action, such as, for example, protein, milk, beer, lemonade and glue and surface-active constituents from labels. The detergent compositions possess this extremely low tendency to foam formation not only at the working temperatures of such cleaning plants, that is to say at temperatures above about 40° C., but also at low temperatures, so that, when the plants are newly charged with cold water and are heated up, there is no formation of troublesome foam which can then lead to foaming over or to breakdowns in the circulation of the plant.

In addition to the advantages already mentioned, the surface-active compositions according to the invention also have the following important advantages as cleansing agents for the mechanical cleaning of hard surfaces, particularly in respect of the high requirements which are set in industrial cleaning plants: the mixtures are not only stable to alkali, but are also stable when stored for prolonged periods together with alkali. The excellent soil uptake capacity makes possible a long service life in the plant, until the latter is filled again, without impairing the cleaning action. Good wetting power and run-off behavior makes possible rapid removal of dirt and thus a high throughput of material to be cleaned. Freedom from spots and streaks is also ensured, as is high gloss of the cleaned material. This makes the compositions according to the invention extremely suitable, for example, for cleaning bottles in breweries which have a very high throughput of bottles, and it is possible, because of the substantial freedom from foaming, to discharge, without problems, the labels which have been removed, and it is also established that, when the cleaned bottles are filled with foaming beverages, the latter are not impaired by reason of the foam collapsing.

"Articles having a hard surface" within the meaning of the end use of the detergent compositions according to the invention are to be understood here as meaning essentially all types of crockery and bottles made of glass, porcelain, ceramics and plastics, and also other objects made of the said materials or of metals.

The invention is illustrated by means of the following examples:

The following components are present in the detergent compositions employed in the following examples ($C_{7-11}$ and the like denotes that $R^1$ has a chain length within the range specified):

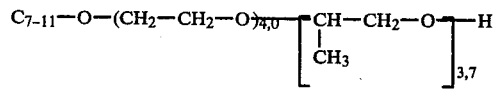

(a)

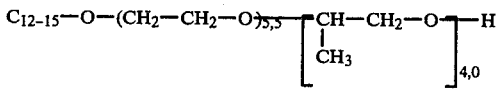

(b)

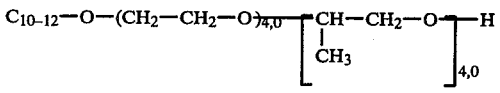

(c)

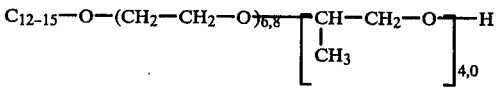

(d)

Nonionic surfactants of the formula ($A^2$)

(e) $C_{10-12}$—O—($CH_2$—$CH_2$—O)$_9$—$CH_2$—O—n—$C_4H_9$ Nonionic surfactants of the formula ($A^3$)

(f) $C_{10-12}$—O—($CH_2$—$CH_2$—O)$_{10}$—tert.—$C_4H_9$ (g) $C_{10-14}$—O—($CH_2$—$CH_2$—O)$_7$—tert.—$C_4H_9$ Cationic surfactants of the formula (B)

(h) Trimethylbenzylammonium chloride (i) Tetrabutylammonium chloride (j) Dibutyldimethylammonium chloride (k) Dihexyldimethylammonium chloride (l) Dioctyldimethylammonium chloride Fluorinated alcohols of the formula (C)

(m) $CF_3$—($CF_2$)$_7$—CH($CH_3$)—OH (n) $CF_3$—($CF_2$)$_7$—C($CH_3$)$_2$—OH (o) $CF_3$—($CF_2$)$_7$—$C_2H_4$—OH (p) $CF_3$—($CF_2$)$_9$—$C_2H_4$—OH (q) $CF_3$—($CF_2$)$_{5/7/9/11}$—$C_2H_4$—OH (Mixture $C_{-5/7/9/11}$=4:3:2:1)

The properties which follow are determined on the said compositions (all determinations were carried out on cleaning liquors which, except for the pulverulent formulations, had been adjusted to a pH value of 13 with NaOH):

(α) Foaming behavior of the detergent composition:

The determination is carried out in an aqueous solution as specified in DIN Standard Specification 53,902 at 25° C. and 65° C.

(β) Foaming behavior in the presence of 10% by weight of beer:

The determination is carried out in an aqueous cleaning liquor containing 10% by weight of wheaten beer (Export-Weizen of Klosterbrauerei Raitenhaslach-Burghausen) at 65° C. as specified in DIN Standard Specification 53,902.

(γ) Determination of the soil uptake limit:

The soil uptake limit is determined by testing the foaming power at an increasing soil load, by adding a test foamer to a cleaning liquor in stages. The test foamer used is a whisked up egg, which is added in portions of 0.2 g/l of liquor. In the foam test specified in DIN Standard Specification 53,902, the soil uptake limit can be recognized by an abrupt increase of foam in the cleaning liquor. 30 ml (at 65° C.) is taken as the upper limit of the foam.

(δ) Testing the run-off behavior in cleaned bottles:

100 ml of the cleaning liquor is put into clean 0.5 l beer bottles, which are closed with a cork stopper and shaken vigorously five times. After a short dwell time (approx. 1 minute) the shaking process is again repeated five times and the surfactant-containing cleaning liquor is then poured out. The bottles are then rinsed four to five times successively, using 100 ml of distilled water each time, until a pH of 7 is reached.

Visual observation of the run-off behavior on the inner wall of the bottles: formation of drops indicates substantivity on the walls of the bottles.

EXAMPLES 1 TO 3

Determination of the volume of foam in ml as specified in DIN Standard Specification 53,902, adding varying quantities of fluorinated alcohols (components m to q) in % by weight (relative to the total of nonionic+cationic constituents A+B=100%).

EXAMPLE 1

A mixture composed of 50% by weight of component f and 50% by weight of component k; 1.5 g/l of aqueous liquor.

| Mixture | Quantity of fluorinated alcohol added, in % by weight | | | | | |
|---|---|---|---|---|---|---|
| | 0.1% | 1% | 5% | 10% | 15% | 20% |
| no additive | 70 | 70 | 70 | 70 | 70 | 70 |
| + Component m | 50 | 50 | 30 | 30 | 30 | 10 |
| + Component n | 40 | 40 | 40 | 30 | 30 | 20 |
| + Component o | 70 | 70 | 70 | 70 | 60 | 40 |
| + Component p | 40 | 40 | 30 | 20 | 0 | 0 |
| + Component q | 50 | 50 | 50 | 40 | 40 | 10 |

EXAMPLE 2

A mixture composed of 30% by weight of component d and 70% by weight of component j; 1.5 g/l of aqueous liquor.

| Mixture | Quantity of fluorinated alcohol added, in % by weight | | | | | |
|---|---|---|---|---|---|---|
| | 0.1% | 1% | 5% | 10% | 15% | 20% |
| no additive | 80 | 80 | 80 | 80 | 80 | 80 |
| + Component m | 80 | 50 | 30 | 20 | 10 | 10 |
| + Component n | 60 | 50 | 30 | 20 | 20 | 20 |
| + Component o | 70 | 70 | 60 | 30 | 20 | 10 |
| + Component p | 70 | 50 | 30 | 20 | 10 | 0 |
| + Component q | 70 | 70 | 50 | 30 | 20 | 10 |

EXAMPLE 3

A mixture composed of 60% by weight of component e and 40% by weight of component l; 1.5 g/l of aqueous liquor.

| Mixture | Quantity of fluorinated alcohol added, in % by weight | | | | | |
|---|---|---|---|---|---|---|
| | 0.1% | 1% | 5% | 10% | 15% | 20% |
| no additive | 60 | 60 | 60 | 60 | 60 | 60 |
| + Component m | 50 | 40 | 30 | 30 | 20 | 10 |
| + Component n | 50 | 40 | 30 | 30 | 20 | 10 |
| + Component o | 60 | 60 | 40 | 30 | 30 | 20 |
| + Component p | 50 | 40 | 20 | 20 | 0 | 0 |
| + Component q | 60 | 50 | 30 | 30 | 30 | 20 |

EXAMPLE 4

Pulverulent spray cleaner:

5% by weight of a detergent composition composed of 34 parts by weight of component g, 66 parts by weight of component k and 1 part by weight of component n; builders and auxiliaries: 65% by weight of sodium metasilicate, 20% by weight of sodium hydroxide (pulverized) and 10% by weight of sodium carbonate.

The surfactant components are first mixed with one another and the fluorinated alcohol is then stirred in at 30° to 40° C. The builders and auxiliaries are added in a drum mixer and are thoroughly mixed there with the surfactant mixture.

The following determinations are made on a cleaning liquor containing 20 g/l of the total formulation (=1 g/l of the detergent composition A+B) in completely demineralized water at pH 12.8. Inherent foam at 25° C. (as specified in DIN Standard Specification 53,902): 10 ml. Inherent foam at 65° C. (as specified in DIN Standard Specification 53,902): 0 ml. Run-off behavior after final rinse with water: no formation of drops.

EXAMPLE 5

Pulverulent bottle cleaner:

10% by weight of a detergent composition composed of 78 parts by weight of component a, 22 parts by weight of component i and 11 parts by weight of component q; builders and auxiliaries: 25% by weight of pentasodium triphosphate, 25% by weight of sodium metasilicate, 25% by weight of sodium carbonate and 15% by weight of sodium hydroxide (pulverized).

The components of the detergent composition are first mixed with one another and are then intimately mixed, to form a powder, with the builders and auxiliaries, which have already been mixed.

The following determinations are carried out on a cleaning liquor containing 5 g/l of the total formulation (=0.45 g/l of the detergent composition A+B) in completely demineralized water at pH 12.4. Inherent foam at 25° C. (as specified in DIN Standard Specification 53,902): 20 ml. Inherent foam at 65° C. (as specified in DIN Standard Specification 53,902): 0 ml. Foam at 65° C. (as specified in DIN Standard Specification 53,902) at a beer loading of 10% by weight: 0 ml. Maximum protein loading (to give 30 ml of foam): 7.2 g/l. Run-off behavior after final rinse with water: no formation of drops.

EXAMPLE 6

Pulverulent crockery cleaner:

2% by weight of a detergent composition composed of 68 parts by weight of component b, 32 parts by weight of component j and 5 parts by weight of component p; builders and auxiliaries: 41.5% by weight of sodium metasilicate, 35% by weight of pentasodium triphosphate, 20% by weight of sodium carbonate and 1.5% by weight of sodium dichloroisocyanurate (as a disinfectant).

The pulverulent components are first mixed with one another. The surfactant-containing formulation, in which the components have previously been mixed with one another in the sequence given, is then incorporated into this mixture.

Determinations are carried out on a cleaning liquor containing 50 g/l of the total formulation (=0.95 g/l of the detergent composition A+B) in completely demineralized water at pH 12.8. Inherent foam at 25° C. (as specified in DIN Standard Specification 53,902): 10 ml. Inherent foam at 65° C. (as specified in DIN Standard Specification 53,902): 0 ml. Maximum protein loading (to give 30 ml of foam): 17.5 g/l. Run-off behavior after final rinse with water: no formation of drops.

EXAMPLE 7

Liquid bottle cleaner:

20% by weight of a detergent composition composed of 76 parts by weight of component c, 24 parts by weight of component k, 8 parts by weight of polypropylene glycol (MW 3,000) and 0.05 part by weight of component o; builders and auxiliaries: 35% by weight of phosphoric acid (85% strength by weight), 20% by weight of 2-phosphonobutane-1,2,4-tricarboxylic acid and 25% by weight of completely demineralized water.

The composition is prepared by first taking completely demineralized water and then stirring in phosphoric acid and 2-phosphonobutane-1,2,4-tricarboxylic acid. The detergent composition thus premixed is then homogenized.

Determinations are carried out on a cleaning liquor containing 10 g/l of the total formulation (=1.85 g/l of the detergent composition A+B) in NaOH solution, pH 13. Inherent foam at 25° C. (as specified in DIN Standard Specification 53,902): 10 ml. Inherent foam at 65° C. (as specified in DIN Standard Specification 53,902): 0 ml. Foam at 65° C. (as specified in DIN Standard Specification 53,902) at a beer loading of 10% by weight: 0 ml. Run-off behavior after final rinse with water: no formation of drops.

EXAMPLE 8

Liquid crockery cleaner:

5% by weight of a detergent composition composed of 50 parts by weight of component e, 25 parts by weight of component l, 25 parts by weight of component h and 2 parts by weight of component m; builders and auxiliaries: 10% by weight of phosphoric acid (85% strength by weight), 5% by weight of pentasodium triphosphate and 80% by weight of completely demineralized water.

The pentasodium triphosphate is dissolved in completely demineralized water and the phosphoric acid is then added, followed by the detergent composition.

Determinations are carried out on a cleaning liquor containing 10 g/l of the total formulation (=0.5 g/l of the detergent composition A+B) in NaOH solution, pH 13. Inherent foam at 25° C. (as specified in DIN Standard Specification 53,902): 10 ml. Inherent foam at 65° C. (as specified in DIN Standard Specification 53,902): 0 ml. Maximum protein loading (to give 30 ml of foam): 9.0 g/l. Run-off behavior after final rinse with water: no formation of drops.

We claim:

1. A detergent composition for the mechanical cleaning of hard surfaces in aqueous alkaline cleaning liquors, which comprises (A) 20 to 95% by weight, of the total weight of the mixture A+B, of a nonionic surfactant of the formula

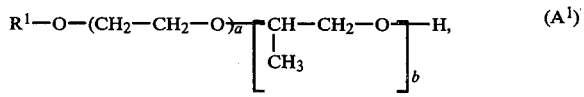

(A¹)

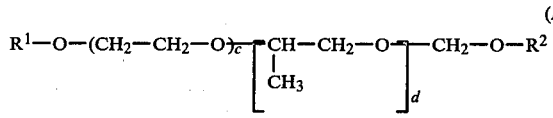

(A²)

or

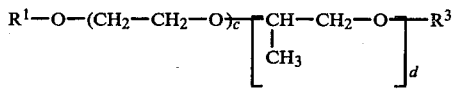

(A³)

or a mixture of the formulae (A¹), (A²) and/or (A³), in which $R^1$ is an alkyl radical having 6 to 22 C atoms, $R^2$ is an alkyl radical having 1 to 6 C atoms, $R^3$ is an alkyl radical having 1 to 4 C atoms, a is a statistical average value within the range from 2 to 10, b is a statistical average value within the range from 1 to 8, c is a statistical average value within the range from 5 to 20 and d is a statistical average value within the range from 0 to 3, and (B) 5 to 80% by weight, of the total weight of the mixture A+B, of a cationic surfactant of the formula

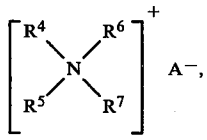

in which $R^4$ and $R^5$ are identical or different alkyl radicals having 1 to 12 C atoms, $R^6$ is an alkyl radical having 1 to 8 C atoms and $R^7$ is an alkyl radical having 1 to 4 C atoms or a benzyl radical, and A denotes an anion, and, additionally, (C) 0.001 to 20% by weight, relative to the total weight A+B=100, of a fluorinated alcohol of the formula

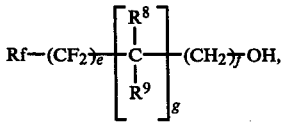

in which Rf is a perfluoromethyl or perfluoroisopropyl radical, $R^8$ is an alkyl radical having 1 to 3 C atoms, $R^9$ is hydrogen or an alkyl radical having 1 to 3 C atoms, e denotes an integer from 5 to 15, f denotes an integer from 0 to 4 and g assumes the value 0 in the case of f=1 to 4, and assumes the value 1 in the case of f=0.

2. A detergent composition comprising a surfactant-containing mixture as claimed in claim 1, which mixture comprises 30 to 70% by weight of the nonionic surfactant (A) and 70 to 30% by weight of the cationic surfactant (B).

3. A detergent composition comprising a surfactant-containing mixture as claimed in claim 1 or 2, wherein an effective quantity of an organic solubilizer has been added to the fluorinated alcohol.

4. A method for the mechanical cleaning of hard surfaces, which comprises treating said hard surfaces with an aqueous alkaline cleaning liquor containing an effective amount of the detergent composition as claimed in claim 1.

5. The method of claim 4, wherein the aqueous alkaline liquor has a pH of $\geqq 10$.

6. The method of claim 4, wherein the aqueous alkaline liquor has a pH of $\geqq 12$.

7. The method of claim 4, wherein the aqueous alkaline cleaning liquor has a pH of at least 10, and the method of treating said hard surfaces includes the step of vigorous mechanical agitation of the aqueous alkaline cleaning liquor.

8. The method of claim 7, wherein the vigorous mechanical agitation takes place in the presence of protein-containing soil and glue and printing ink residues.

9. A detergent composition comprising the surfactant mixture of claim 1 in combination with sufficient sodium hydroxide to adjust the pH of said composition, when in said aqueous alkaline liquor, to at least 10.

10. A detergent composition of claim 8, wherein said pH is at least 12.

* * * * *